US010399243B1

(12) United States Patent
Lozier

(10) Patent No.: US 10,399,243 B1
(45) Date of Patent: Sep. 3, 2019

(54) GLUE INJECTING APPARATUS

(71) Applicant: Louis Lozier, Lakeville, NY (US)

(72) Inventor: Louis Lozier, Lakeville, NY (US)

( * ) Notice: Subject to any disclaimer, the term of this patent is extended or adjusted under 35 U.S.C. 154(b) by 0 days.

(21) Appl. No.: 15/905,964

(22) Filed: Feb. 27, 2018

(51) Int. Cl.
*B27G 11/00* (2006.01)
*B05C 17/005* (2006.01)

(52) U.S. Cl.
CPC ..... *B27G 11/005* (2013.01); *B05C 17/00569* (2013.01)

(58) Field of Classification Search
CPC .. B27G 11/005; B27G 11/00; B05C 17/00569
USPC ..... 222/173
See application file for complete search history.

(56) References Cited

U.S. PATENT DOCUMENTS 1,690,221 A * 11/1928 Fesler ..... F16N 3/10 222/173
2,694,211 A 11/1954 Warren
3,316,853 A * 5/1967 Schneller ..... F04B 9/14 222/256
4,093,170 A * 6/1978 Spray ..... F16M 13/00 248/520
4,168,787 A * 9/1979 Stamper ..... F16N 3/12 222/256
4,601,412 A * 7/1986 Martin ..... F16N 3/12 222/256
4,664,298 A * 5/1987 Shew ..... F16N 3/12 184/105.2
4,946,077 A * 8/1990 Olsen ..... F16N 3/12 184/105.2
5,221,348 A 6/1993 Masano
5,224,625 A * 7/1993 Holtier ..... B05B 1/30 200/83 B
5,918,702 A * 7/1999 Cheng ..... B05C 17/00569 184/105.2
5,928,468 A * 7/1999 Tolson ..... A61B 17/8811 144/330
6,415,958 B1 * 7/2002 Donley ..... B05B 12/00 222/146.5
6,467,579 B1 10/2002 Simon
7,063,298 B2 * 6/2006 Henry ..... B25H 3/04 222/251
7,455,196 B2 * 11/2008 Montgomery ..... F16N 3/12 222/179
9,447,918 B2 * 9/2016 Prest ..... B25H 1/0064
D788,553 S 6/2017 Hung
2005/0230429 A1 * 10/2005 Weems ..... F16N 3/12 222/383.1

(Continued)

FOREIGN PATENT DOCUMENTS

CA 2284568 5/2004

*Primary Examiner* — Benjamin R Shaw

(57) ABSTRACT

The glue injecting apparatus is configured for use with an adhesive. The glue injecting apparatus is configured for use in injecting the adhesive to a mortise and tenon joint. The glue injecting apparatus comprises a pedestal, a reservoir, a pump, and a nozzle assembly. The reservoir contains the adhesive. The pedestal supports the reservoir above a supporting surface. The pump: 1) attaches the nozzle assembly to the reservoir; and, 2) generates a pressure differential, which is used for transporting the adhesive through the nozzle assembly to the mortise and tenon joint. The nozzle assembly is a flexible structure capable of supporting a fluid under pressure.

8 Claims, 3 Drawing Sheets

(56) References Cited

U.S. PATENT DOCUMENTS

| | | | | |
|---|---|---|---|---|
| 2010/0116850 | A1* | 5/2010 | Weems | F16N 3/12<br>222/256 |
| 2013/0087584 | A1* | 4/2013 | Guo | F16N 3/12<br>222/323 |

* cited by examiner

GLUE INJECTING APPARATUS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of shaping including apparatus for working with wood, wooden furniture and similar materials, more specifically, an apparatus for injecting wood glue under pressure into loose mortise and tenon joints.

SUMMARY OF INVENTION

The glue injecting apparatus is configured for use with wood glue. The glue injecting apparatus is configured for use in injecting the wood glue to one or more surfaces. More specifically, the glue injecting apparatus is configured to inject wood glue to loose mortise and tenon joints of antique and modern furniture, especially, chair legs, table legs, and dresser legs. The glue injecting apparatus injects the wood glue under pressure to the targeted mortise and tenon joint. The glue injecting apparatus comprises a pedestal, a reservoir, a pump, and a nozzle assembly. The reservoir contains the wood glue. The pedestal supports the reservoir above a supporting surface. The pump: attaches the nozzle assembly to the reservoir; and, 2) generates a pressure differential used for transporting the wood glue through the nozzle assembly to the mortise and tenon joint. The nozzle assembly is a flexible structure capable of supporting a fluid under pressure.

These together with additional objects, features and advantages of the glue injecting apparatus will be readily apparent to those of ordinary skill in the art upon reading the following detailed description of the presently preferred, but nonetheless illustrative, embodiments when taken in conjunction with the accompanying drawings.

In this respect, before explaining the current embodiments of the glue injecting apparatus in detail, it is to be understood that the glue injecting apparatus is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the glue injecting apparatus.

It is therefore important that the claims be regarded as including such equivalent construction insofar as they do not depart from the spirit and scope of the glue injecting apparatus. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
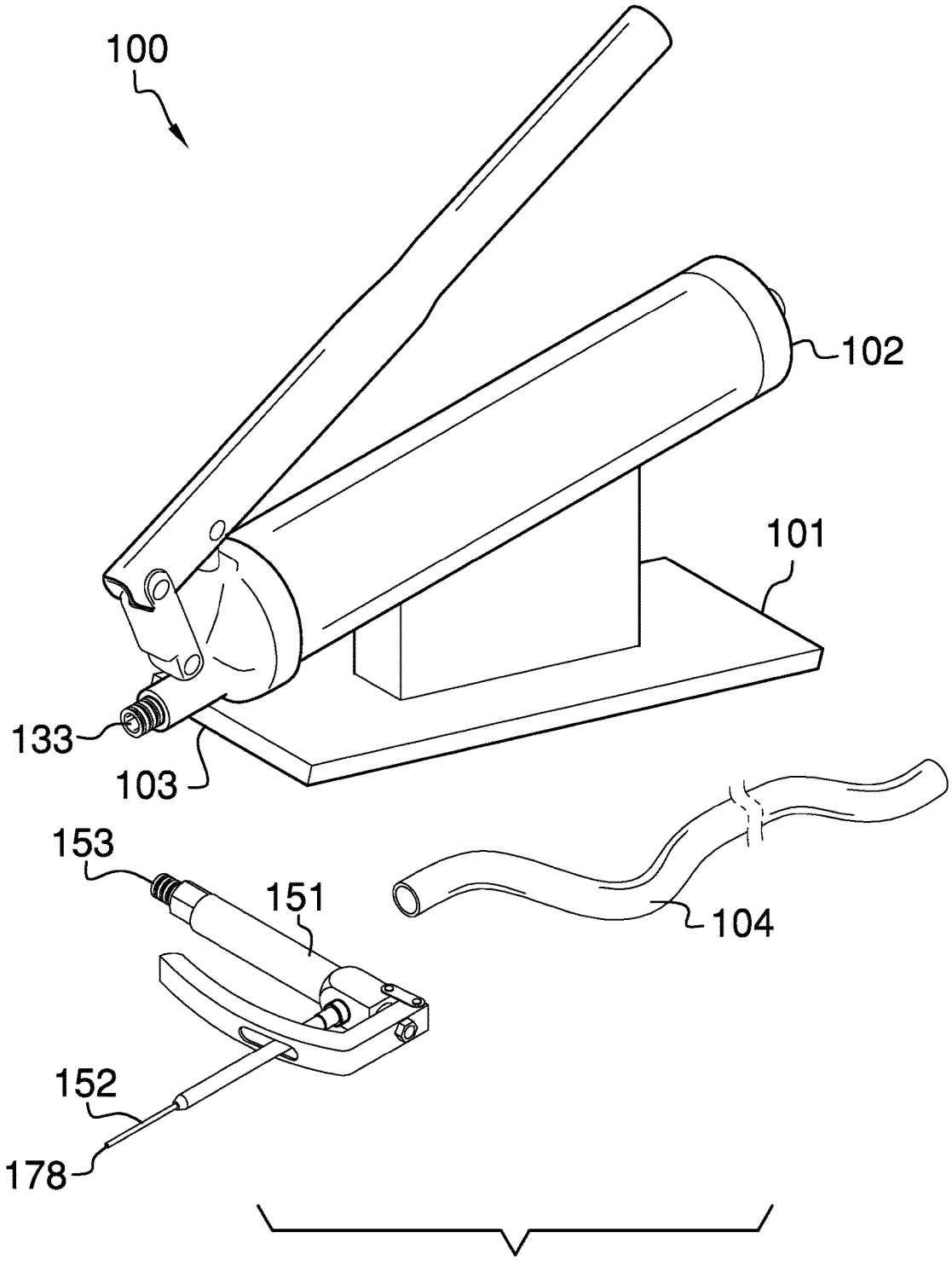
FIG. 1 is a perspective view of an embodiment of the disclosure.
Figure 2:
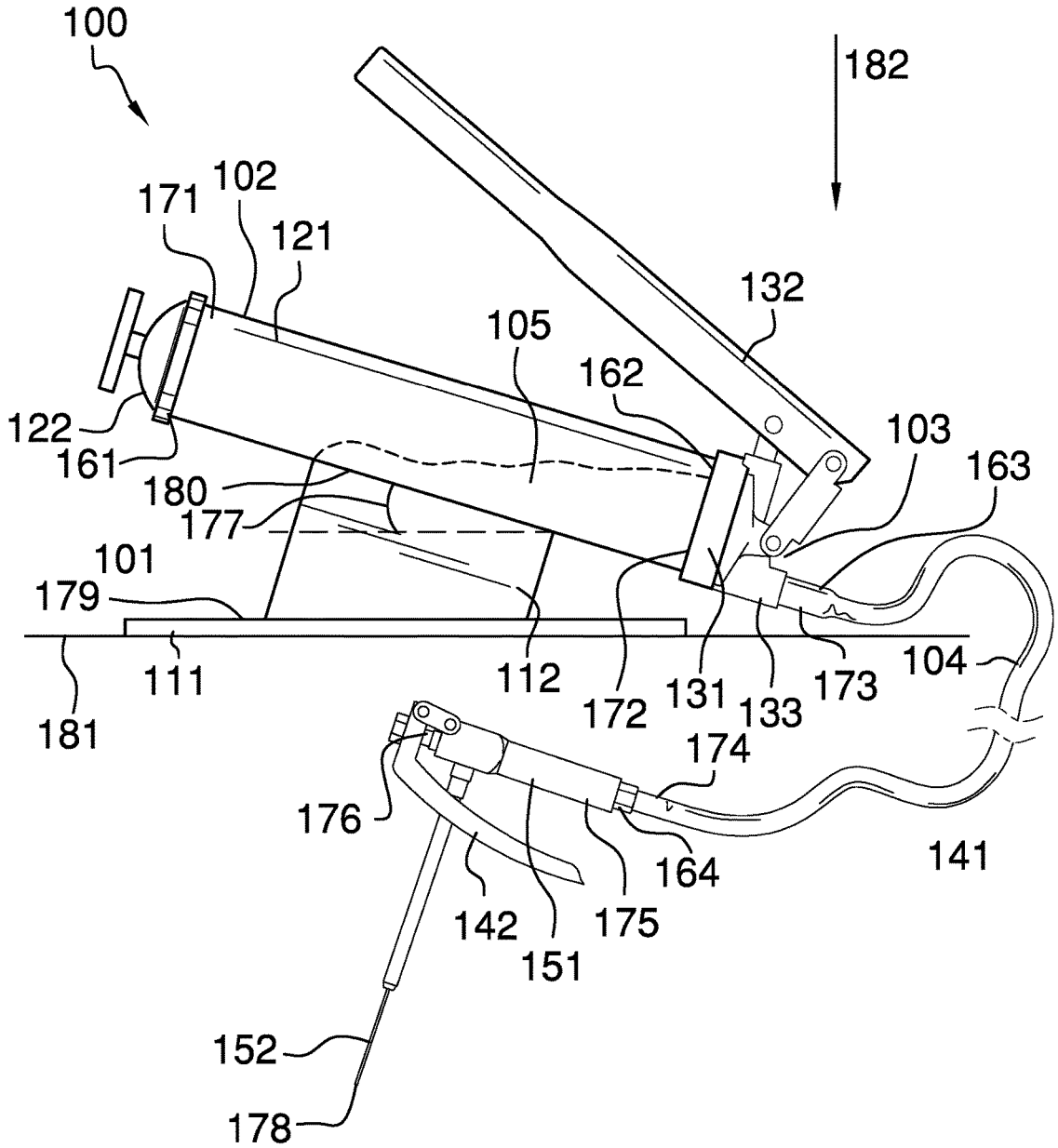
FIG. 2 is a side view of an embodiment of the disclosure.
Figure 3:
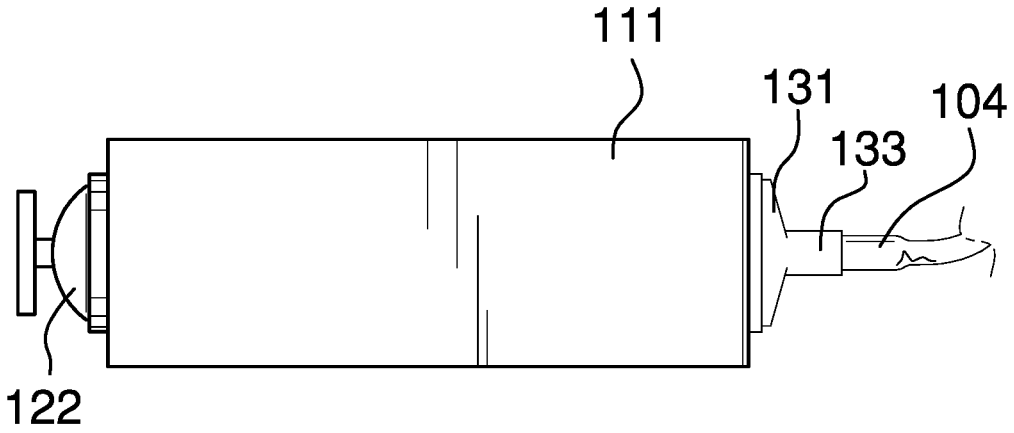
FIG. 3 is a bottom view of an embodiment of the disclosure.

Detailed reference will now be made to one or more potential embodiments of the disclosure, which are illustrated in FIGS. 1 through 3.

The glue injecting apparatus 100 (hereinafter invention) is configured for use with a wood glue 105. The invention 100 is configured for use in injecting the wood glue 105 to a mortise and tenon joint. More specifically, the invention 100 is configured to inject wood glue 105 to loose mortise and tenon joints of antique and modern furniture, especially, chair legs, table legs, and dresser legs. The invention 100 injects the wood glue 105 under pressure to the targeted mortise and tenon joint. The invention 100 comprises a pedestal 101, a reservoir 102, a pump 103, and a nozzle assembly 104. The reservoir 102 contains the wood glue 105. The pedestal 101 supports the reservoir 102 above a supporting surface 181. The pump 103: 1) attaches the nozzle assembly 104 to the reservoir 102; and, 2) generates a pressure differential used for transporting the wood glue 105 through the nozzle assembly 104 to the mortise and tenon joint. The nozzle assembly 104 is a flexible structure capable of supporting a fluid under pressure.

The wood glue 105 is a commercially available chemical substance that adheres a first surface to a second surface. In the first potential embodiment of the disclosure, the wood glue 105 is liquid form.

The pedestal 101 is the supporting structure of the invention 100 that transfers the load path of the invention 100 to the supporting surface 181. For the purposes of simplicity and clarity, this disclosure assumes that the pedestal 101 is placed on a supporting (horizontal) surface 181 that is perpendicular to the force of gravity 182. Those skilled in the mechanical arts will recognize that modifying the pedestal 101 for use on other types of supporting surfaces 181, such as a vertical surface, can be made with without undue experimentation. The pedestal 101 comprises a base 111 and a stanchion 112. The stanchion 112 is further defined with a cant 177, an inferior edge 170, and a superior edge 180.

The base 111 is a rectangular block shaped plate. The base 111 forms the inferior structure of the pedestal 101 and the invention 100. The base 111 rests upon the supporting surface 181. The stanchion 112 is an extension structure. The stanchion 112 raises the reservoir 102 such that a separation in distance exists between the supporting surface 181 and the reservoir 102.

The reservoir 102 is the container used to store the wood glue 105 in anticipation of the subsequent injection of the wood glue 105. The reservoir 102 comprises a rigid tube 121 and an end cap 122. The rigid tube 121 is further defined with a first end 171 and a second end 172.

The rigid tube 121 is a hollow rigid cylindrical structure. The wood glue 105 is physically stored in the rigid tube 121. The end cap 122 is a capped tube that is used to enclose the first end 171 of the rigid tube 121. The first threaded connection 161 is a threaded connection that attaches the end cap 122 to the rigid tube 121. Methods to form threaded connections are well-known and documented in the mechanical arts. Threaded connections are described in greater detail elsewhere in this disclosure.

The cant 177 is an angle that is formed between the superior edge 180 of the stanchion 112 and a plane that is parallel to the supporting surface 181. The cant 177 makes it easier to refill the reservoir 102 with wood glue 105. The cant 177 further provides improved access to the lever 132 during the injection of the wood glue 105. The cant 177 of the stanchion 112 holds the rigid tube 121 at a similar angle allowing gravity to pull the wood glue 105 to the inferior region located at the second end 172 of the rigid tube 121. The use of the cant 177 in this manner improves the flow of wood glue 105 through the invention 100.

The pump 103 attaches the nozzle assembly 104 to the reservoir 102. The pump 103 is a mechanically operated device. The pump 103 generates a pressure differential that pushes the wood glue 105 from the reservoir 102 and through the nozzle assembly 104 for injection into to the mortise and tenon joint. The design and use of a pump 103 for the purpose described in this disclosure are well-known and documented in the mechanical and plumbing arts. The pump 103 comprises a mechanism 131, a lever 132, and a first zerk 133.

The mechanism 131 is a mechanical device that creates a pressure differential that forces the wood glue 105 to flow from the reservoir 102 into the nozzle assembly 104. The pressure differential formed by the mechanism 131 forces the wood glue 105 through the nozzle assembly 104 from which the wood glue 105 is subsequently dispensed into the mortise and tenon joint. In the first potential embodiment of the disclosure, the mechanism 131 is a manually operated device. Similar mechanisms driven by external power sources may be substituted. Those skilled in the mechanical art will recognize that this substitution can be accomplished without undue experimentation.

The design and the use of a mechanism 131 to create a pressure differential are well-known and documented in the mechanical arts. The second threaded connection 162 attaches the mechanism 131 to the rigid tube 121. Methods to form threaded connections are well-known and documented in the mechanical arts. Threaded connections are described in greater detail elsewhere in this disclosure.

The lever 132 is a handle that is used to operate the mechanism 131. The lever 132 rotates around a pivot. The length of the lever 132 is selected such that the lever 132 can provide leverage when operating the pump 103.

The first zerk 133 is a fitting formed on the mechanism 131. The first zerk 133 is an aperture: 1) through which the wood glue 105 discharges during the pumping process; and, 2) to which the nozzle assembly 104 attaches using the second threaded connection 162.

The nozzle assembly 104 is a flexible cylindrical structure capable of transporting fluids under pressure. The nozzle assembly 104 transports the wood glue 105 from the reservoir 102 and injects the wood glue 105 into the mortise and tenon joint. The nozzle assembly 104 is a commercially available product that is selected to withstand the pressures generated by the pump 103. The size of the nozzle assembly 104, as measured by the inner diameter of the nozzle assembly 104, is selected based on a previously specified flow rate of wood glue 105 through the nozzle assembly 104. The nozzle assembly 104 comprises a flexible hose 141 and a trigger nozzle 142. The flexible hose 141 is further defined with a third end 173 and a fourth end 174.

The flexible hose 141 is a hollow cylindrical structure formed from an elastomeric material. The flexible hose 141: 1) physically attaches to the first zerk 133; and, 2) physically transports the wood glue 105 into the trigger nozzle 142. The third threaded connection 163 attaches the nozzle assembly 104 to the first zerk 133 of the mechanism 131. Methods to form threaded connections are well-known and documented in the mechanical arts. Threaded connections are described in greater detail elsewhere in this disclosure.

The trigger nozzle 142 attaches to the end of the flexible hose 141 that is distal from the pump 103. The trigger nozzle 142 controls the flow of wood glue 105 from the nozzle assembly 104 until it is discharged into the mortise and tenon joint. The trigger nozzle 142 further controls the rate of flow of the wood glue 105 through the trigger nozzle 142. The trigger nozzle 142 comprises a valve 151, a needle 152, and a second zerk 153. The valve 151 is further defined with a fifth end 175 and a sixth end 176. The needle 152 is further defined with a bevel 178. The bevel 178 refers to the free end of the needle 152. The bevel 178 is the end of the needle 152 that discharges the wood glue 105.

The valve 151 is a commercially available manually operated spring loaded valve. In the first potential embodiment of the disclosure, the valve 151 is a needle valve. The valve 151 physically controls the flow of wood glue 105 through the trigger nozzle 142. The valve 151 is opened and closed by squeezing a handle associated with and provisioned with the valve 151.

The needle 152 is a hollow rigid tubular structure that attaches to the end of the valve 151 that is distal from the second zerk 153. The wood glue 105 is discharged through the needle 152 during the injection of the wood glue 105 into the mortise and tenon joint.

The second zerk 153 is a fitting formed on the valve 151. The second zerk 153 receives the wood glue 105 from the nozzle assembly 104. The fourth threaded connection 164 attaches the nozzle assembly 104 to the second zerk 153 of the valve 151. Methods to form threaded connections are well-known and documented in the mechanical arts. Threaded connections are described in greater detail elsewhere in this disclosure.

The following two paragraphs describe the assembly of the invention 100.

The first zerk 133 attaches to the mechanism 131 at a location that is distal from the rigid tube 121. The second zerk 153 attaches to the fifth end 175 of the valve 151. The first threaded connection 161 attaches the end cap 122 to the first end 171 of the rigid tube 121. The second threaded connection 162 attaches the mechanism 131 to the second end 172 of the rigid tube 121. The third threaded connection 163 attaches the third end 173 of the flexible hose 141 to the first zerk 133. The fourth threaded connection 164 attaches the fourth end 174 of the flexible hose 141 to the second zerk 153. The needle 152 attaches to the sixth end 176 of the valve 151 in the manner of a cantilever.

The inferior edge 179 of the stanchion 112 attaches to the base 111 such that the stanchion 112 projects perpendicularly away from the base 111. The superior edge 180 attaches to the rigid tube 121 such that the reservoir 102 is raised above the supporting surface 181. The superior edge 180 is the edge of the stanchion 112 that is distal from the inferior edge 179.

The following definitions were used in this disclosure:

Adhesive: As used in this disclosure, an adhesive is a chemical substance that can be used to adhere two or more objects to each other.

Cant: As used in this disclosure, a cant is an angular deviation from one or more reference planes such as a vertical plane or a horizontal plane.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Capped Tube: As used in this disclosure, a capped tube is a tube with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Cylinder: As used in this disclosure, a cylinder is a geometric structure defined by two identical flat and parallel ends, also commonly referred to as bases, which are circular in shape and connected with a single curved surface, referred to in this disclosure as the lateral face. The cross-section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Elastic: As used in this disclosure, an elastic is a material or object that deforms when a force is applied to it and that is able to return to its relaxed shape after the force is removed. A material that exhibits these qualities is also referred to as an elastomeric material.

Extension Structure: As used in this disclosure, an extension structure is an inert physical structure that is used to extend the span of the distance between any two objects.

Exterior Screw Thread: An exterior screw thread is a ridge wrapped around the outer surface of a tube in the form of a helical structure that is used to convert rotational movement into linear movement.

External Power Source: As used in this disclosure, an external power source is a source of the energy that is externally provided to enable the operation of the present disclosure. Examples of external power sources include, but are not limited to, electrical power sources and compressed air sources.

Force of Gravity: As used in this disclosure, the force of gravity refers to a vector that indicates the direction of the pull of gravity on an object at or near the surface of the earth.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Hose: As used in this disclosure, a hose is a flexible hollow cylindrical device used for transporting liquids and gases. When referring to a hose in this disclosure, the terms inner diameter and outer diameter are used as they would be used by those skilled in the plumbing arts.

Inferior: As used in this disclosure, the term inferior refers to a directional reference that is parallel to and in the same direction as the force of gravity.

Interior Screw Thread: An interior screw thread is a groove that is formed around the inner surface of a tube in the form of a helical structure that is used to convert rotational movement into linear movement.

Lever: As used in this disclosure, a lever is a simple machine that comprises a shaft that rotates around a fulcrum or pivot point.

Lid: As used in this disclosure, a lid is a removable cover that is placed over an opening of a hollow structure to enclose the hollow structure.

Liquid: As used in this disclosure, a liquid refers to a state (phase) of matter that is fluid and that maintains, for a given pressure, a fixed volume that is independent of the volume of the container.

Load Path: As used in this disclosure, a load path refers to a chain of one or more structures that transfers a load generated by a raised structure or object to a foundation, supporting surface, or the earth.

Mortise: As used in this disclosure, a mortise is a cavity formed in a material that is designed to receive a similarly shaped object such that the similarly shaped object is flush to the surface of the material.

Needle: As used in this disclosure, a needle is a hollow, narrow cylindrical device with a release aperture at one end.

The needle is used as a nozzle to release fluid in a controlled manner. The free end of a needle is called the bevel. The bevel of a needle is often sharpened or otherwise brought to a point.

Nozzle: As used in this disclosure, a nozzle is a device that receives liquid under pressure and releases the fluid in a controlled manner into an environment.

Pedestal: As used in this disclosure, a pedestal is an intermediary load-bearing structure that that transfers a load path between a supporting surface and an object, structure, or load.

Plate: As used in this disclosure, a plate is a smooth, flat and semi-rigid or rigid structure that has at least one dimension that: 1) is of uniform thickness; and 2) that appears thin relative to the other dimensions of the object. Plates often have a rectangular or disk-like appearance.

Pump: As used in this disclosure, a pump is a mechanical device that uses suction or pressure to raise or move fluids, compress fluids, or force a fluid into an inflatable object. Within this disclosure, a compressor refers to a pump dedicated to compressing a fluid or placing a fluid under pressure.

Rectangular Block: As used in this disclosure, a rectangular block refers to a three-dimensional structure comprising six rectangular surfaces formed at right angles. Within this disclosure, a rectangular block may further comprise rounded edges and corners.

Reservoir: As used in this disclosure, a reservoir refers to a container or containment system that is configured to store a liquid.

Rounded: A used in this disclosure, the term rounded refers to the replacement of an apex, vertex, or edge or brink of a structure with a (generally smooth) curvature wherein the concave portion of the curvature faces the interior or center of the structure.

Rounded Rectangle: A used in this disclosure, a rounded rectangle is a rectangle wherein one or more of the corner structures of the rectangle are replaced with a curvature wherein the concave portion of the curvature faces the center of the rounded rectangle.

Stanchion: As used in this disclosure, a stanchion refers to a vertical pole, post, or support.

Superior: As used in this disclosure, the term superior refers to a directional reference that is parallel to and in the opposite direction of the force of gravity.

Supporting Surface: As used in this disclosure, a supporting surface is a horizontal surface upon which an object is placed. This disclosure assumes that the object is placed on the supporting surface in an orientation that is appropriate for the normal or anticipated use of the object.

Tenon: As used in this disclosure, a tenon is a structure that projects away from an edge a first object (often the end of a piece of wood). The tenon is sized and shaped to fit into a mortise that is formed in a second object such that the first object can be attached to the second object by inserting the tenon in the matching mortise.

Threaded Connection: As used in this disclosure, a threaded connection is a type of fastener that is used to join a first tube-shaped and a second tube-shaped object together. The first tube-shaped object is fitted with a first fitting selected from an interior screw thread or an exterior screw thread. The second tube-shaped object is fitted with the remaining screw thread. The tube-shaped object fitted with the exterior screw thread is placed into the remaining tube-shaped object such that: 1) the interior screw thread and the exterior screw thread interconnect; and, 2) when the tube-shaped object fitted with the exterior screw thread is rotated the rotational motion is converted into linear motion that moves the tube-shaped object fitted with the exterior screw thread either into or out of the remaining tube-shaped object. The direction of linear motion is determined by the direction of rotation.

Trigger: As used in this disclosure, a trigger is a lever that operates in conjunction with a spring or similar device such that: 1) the lever is used to activate a mechanism; and 2) the spring or similar device returns the lever to its original position after the mechanism has been activated.

Tube: As used in this disclosure, a tube is a hollow cylindrical device used for transporting liquids and gases. The line that connects the center of the first base of the cylinder to the center of the second base of the cylinder is referred to as the center axis of the tube or the centerline of the tube. In this disclosure, the terms inner diameter of a tube and outer diameter of a tube are used as they would be used by those skilled in the plumbing arts.

Valve: As used in this disclosure, a valve is a device used to control the flow of a fluid (gas or liquid) through a pipe.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wood Glue: As used in this disclosure, wood glue is a type of adhesive that is formulated specifically for adhering together wooden components to form a wooden object.

Zerk: As used in this disclosure, a zerk is a fitting that is used to inject a fluid into a device.

With respect to the above description, it is to be realized that the optimum dimensional relationship for the various components of the invention described above and in FIGS. 1 through 3 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention. Specifically, the applicant points out that the invention described above and in FIGS. 1 through 3 can be used for applying an adhesive to one or more surfaces made from materials other than wood.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A glue injection apparatus comprising:

wherein the glue injection apparatus comprises a pedestal, a reservoir, a pump, and a nozzle assembly;

wherein the pedestal supports the reservoir above a supporting surface;

wherein the pump attaches the nozzle assembly to the reservoir;

wherein the glue injection apparatus is configured for use with a wood glue;

wherein the glue injection apparatus is configured for use in injecting the wood glue;

wherein the reservoir contains the wood glue;
wherein the pump generates a pressure differential used for transporting the wood glue during injection;
wherein the wood glue is in a liquid form;
wherein the pump comprises a lever, and a first zerk;
wherein the pump creates the pressure differential;
wherein a trigger nozzle comprises a valve, a needle, and a second zerk;
wherein the valve is further defined with a fifth end and a sixth end;
wherein a first threaded connection attaches an end cap to a rigid tube;
wherein the rigid tube is further defined with a first end and a second end;
wherein a second threaded connection attaches the pump to the rigid tube;
wherein a third threaded connection attaches the nozzle assembly to the first zerk;
wherein the first zerk attaches at a location that is distal from the rigid tube;
wherein a second zerk attaches to the fifth end of the valve;
wherein the first threaded connection attaches the end cap to the first end of the rigid tube;
wherein the second threaded connection attaches the second end of the rigid tube;
wherein the third threaded connection attaches a third end of a flexible hose to the first zerk;
wherein a fourth threaded connection attaches a fourth end of the flexible hose to the second zerk;
wherein the needle attaches to the sixth end of the valve in the manner of a cantilever;
wherein an inferior edge of the stanchion attaches to a base such that the stanchion projects perpendicularly away from the base;
wherein a superior edge attaches to the rigid tube such that the reservoir is raised above the supporting surface;
wherein the superior edge is the edge of the stanchion that is distal from the inferior edge;
wherein the pedestal comprises the base and the stanchion;
wherein the stanchion attaches to the base;
wherein the stanchion is further defined with a cant, an inferior edge, and a superior edge;
wherein the reservoir comprises the rigid tube and the end cap;
wherein the pump is a mechanically operated device;
wherein the pump generates a pressure differential;
wherein the pressure differential pushes the wood glue from the reservoir into and through the nozzle assembly during injection;
wherein the nozzle assembly is a flexible cylindrical structure;
wherein the nozzle assembly transports the wood glue from the reservoir and releases the wood glue during injection;
wherein the base is a rectangular block shaped plate;
wherein the base forms the inferior structure of the pedestal and the glue injection apparatus;
wherein the base rests upon the supporting surface;
wherein the stanchion is an extension structure;
wherein the stanchion raises the reservoir such that a separation in distance exists between the supporting surface and the reservoir;
wherein the rigid tube is a hollow rigid cylindrical structure;
wherein the end cap is a capped tube;
wherein the end cap encloses the first end of the rigid tube;
wherein the cant is an angle that is formed between the superior edge of the stanchion and a plane that is parallel to the supporting surface;
wherein the cant of the stanchion holds the rigid tube at a similar angle.

2. The glue injection apparatus according to claim 1
wherein the lever is a handle;
wherein the lever rotates around a pivot.

3. The glue injection apparatus according to claim 2
wherein the first zerk is a fitting formed on the pump;
wherein the first zerk is an aperture through which the wood glue discharges during the pumping process;
wherein the nozzle assembly attaches to the first zerk.

4. The glue injection apparatus according to claim 3
wherein the nozzle assembly comprises a flexible hose and a trigger nozzle;
wherein the trigger nozzle attaches to the flexible hose;
wherein the flexible hose is further defined with a third end and a fourth end.

5. The glue injection apparatus according to claim 4
wherein the flexible hose is a hollow cylindrical structure formed from an elastomeric material;
wherein the flexible hose physically transports the wood glue into the trigger nozzle.

6. The glue injection apparatus according to claim 5
wherein the trigger nozzle attaches to the end of the flexible hose that is distal from the pump;
wherein the trigger nozzle controls the flow of wood glue from the nozzle assembly until the wood glue is discharged for injection;
wherein the trigger nozzle further controls the rate of flow of the wood glue through the trigger nozzle.

7. The glue injection apparatus according to claim 6
wherein the needle and the second zerk attach to the valve;
wherein the needle is further defined with a bevel.

8. The glue injection apparatus according to claim 7
wherein the valve physically controls the flow of wood glue through the trigger nozzle;
wherein the valve is opened and closed by squeezing a handle associated with and provisioned with the valve;
wherein the needle is a hollow syringe needle that attaches to the end of the valve that is distal from the second zerk;
wherein the second zerk is a fitting formed on the valve;
wherein the second zerk receives the wood glue from the nozzle assembly;
wherein a fourth threaded connection attaches the nozzle assembly to the second zerk of the valve.

* * * * *